United States Patent [19]

Willcox

[11] Patent Number: 4,502,804

[45] Date of Patent: Mar. 5, 1985

[54] PAPER FEEDING AND GUIDING SYSTEM

[76] Inventor: Frederick P. Willcox, 565 Oenoke Ridge, New Canaan, Conn. 06840

[21] Appl. No.: 564,219

[22] Filed: Dec. 22, 1983

Related U.S. Application Data

[63] Continuation-in-part of Ser. No. 422,935, Sep. 24, 1982, abandoned.

[51] Int. Cl.[3] ..... B41J 13/076; B41J 13/28; B41J 13/10

[52] U.S. Cl. ..... 400/641; 400/642; 400/645; 400/631; 400/690; 271/272

[58] Field of Search ..... 400/579, 630–632.1, 400/617, 641, 636, 642, 636.3, 689, 690, 634, 646, 637–637.7, 600.2; 271/273–275, 272

[56] References Cited

U.S. PATENT DOCUMENTS

| | | | |
|---|---|---|---|
| 2,244,095 | 6/1941 | Botham | 400/632 |
| 3,042,179 | 7/1962 | Stern | 400/600.2 |
| 3,333,671 | 8/1967 | Rohde | 400/646 |
| 3,390,929 | 7/1968 | Gussino | 400/690 |
| 3,461,235 | 8/1969 | Willcox et al. | 172/2.5 |
| 3,469,124 | 9/1969 | Willcox | 310/49 R |
| 3,513,938 | 5/1970 | Buehner et al. | 181/201 |
| 3,534,847 | 10/1970 | Willcox | 400/143 |
| 3,684,076 | 8/1972 | Crain et al. . | |
| 3,712,214 | 1/1973 | Kaneka et al. | 101/232 |
| 3,722,655 | 3/1973 | Singer | 400/636 |
| 3,731,778 | 5/1973 | Willcox | 400/172 |
| 3,838,638 | 10/1974 | Clary | 101/93.22 |
| 3,887,057 | 6/1975 | Stahl et al. | 400/690 |
| 3,892,303 | 7/1975 | Willcox | 400/171 |
| 3,893,662 | 7/1975 | Boyd | 271/273 |
| 3,901,372 | 8/1975 | Denley | 400/690.1 |
| 4,047,607 | 9/1977 | Willcox | 400/208 |
| 4,164,376 | 8/1979 | Yarp | 400/656 |
| 4,173,420 | 11/1979 | Okabe | 400/636.1 |
| 4,188,025 | 2/1980 | Gusfafsen | 400/636 |
| 4,227,821 | 11/1980 | Plaza et al. | 400/647.1 |
| 4,257,282 | 3/1981 | Wilczewski et al. | 400/328 |
| 4,297,045 | 10/1981 | Burton et al. | 400/641 |
| 4,317,565 | 3/1982 | Swette | 271/274 |
| 4,360,279 | 11/1982 | Sugiura | 400/631 |
| 4,386,265 | 5/1983 | Sugimori | 400/636 |
| 4,386,860 | 6/1983 | Price et al. | 400/636 |

FOREIGN PATENT DOCUMENTS

| | | | |
|---|---|---|---|
| 2500418 | 9/1975 | Fed. Rep. of Germany . | |
| 2946033 | 5/1981 | Fed. Rep. of Germany | 400/631 |
| 598987 | 12/1925 | France | 400/646 |
| 101483 | 8/1980 | Japan | 400/641 |
| 133982 | 10/1980 | Japan | 400/689 |

OTHER PUBLICATIONS

Ex. 1–Models and Other Items to Which 3M is Given Title Under Article V.
Ex. 2–Photos of Model 1–W Printer.
Ex. 3–Photos of Model 2–W Printer.
Ex. 4–3 Sheets of Diagrams.
Alexander, "Positive Acoustic Seal", IBM Technical Disclosure Bulletin, vol. 23, No. 6, p. 2357, 11/80.

*Primary Examiner*—William Pieprz
*Attorney, Agent, or Firm*—William D. Hall

[57] ABSTRACT

A paper feeding and guiding system for a printer with a flat platen has twin mating feed rollers fitted with "O" ring type friction elements cooperating with specially curved entrance and exit paper directing and guiding members which keep the paper or other record material flat against the platen face without the use of a bail or vacuum system. The axis of one feed roller is adjustable to alter the rolling radius of the "O" rings from one end of the feed rollers to the other to provide correction for skew feeding of the record material. The exit paper guide is vibration isolated from the platen bar and fitted with a noise control flap to close off the paper entrance cavity. The mechanism for disengaging the feed rollers for paper insertion is combined with a paper alignment guide which is projected into the path of the inserted paper to align the top edge for correct feeding and coincidence with the steps of a stepping motor drive which incrementally drives the feed rollers.

20 Claims, 15 Drawing Figures

10
42
46
44
25
24
58
60
54
52
12
62
64
26
28
30
48
50
56
38
36
25
39
32
34
40
74
68
70
76
72
16
14
22
20
18
80
78
66

10
12
37
39
90
56
60
88
70
94
66
82
76
92
96
84
74
72
98
77
80
80
16
18
81
83
86
78
100
22
14
86
20
102

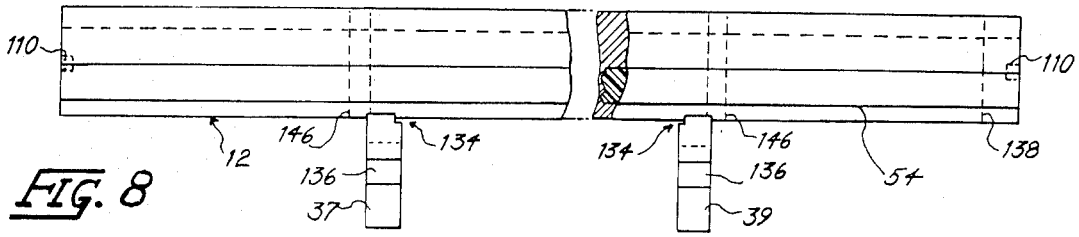
FIG. 8
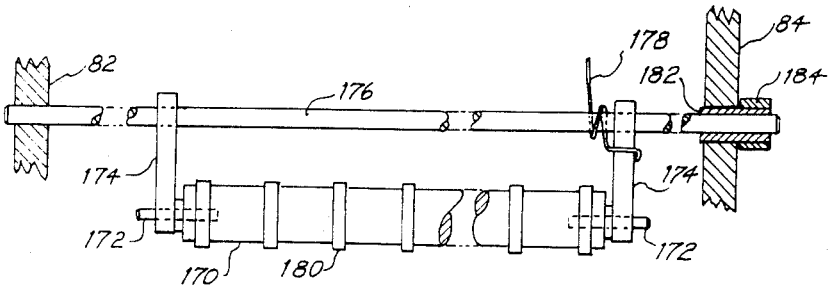
FIG. 9
FIG. 10
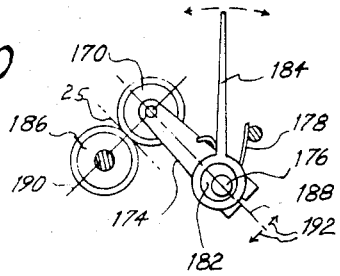
FIG. 11
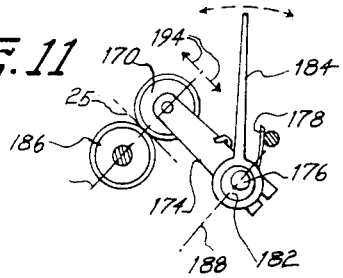
FIG. 12
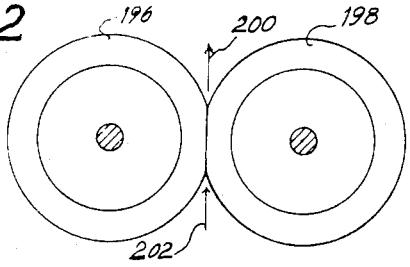
FIG. 13
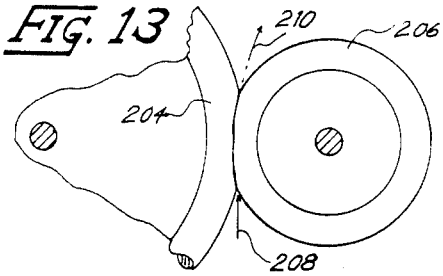
FIG. 14
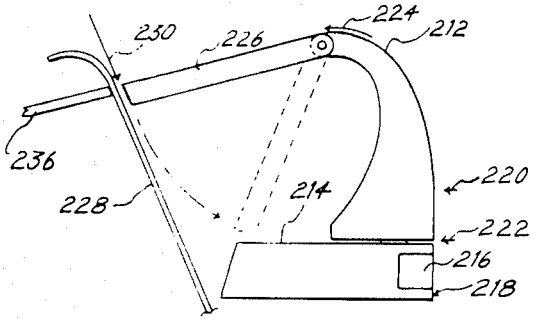
FIG. 15
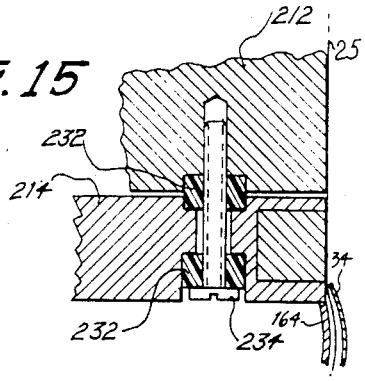

PAPER FEEDING AND GUIDING SYSTEM

RELATED APPLICATIONS

This application is a continuation-in-part application of my prior application Ser. No. 422,935 filed Sept. 24, 1982, entitled "Paper Feeding And Guiding System" and now abandoned.

SUMMARY OF THE INVENTION

The paper feeding and guiding system employs a combination of cooperating and inter-related structures to achieve superior alignment, feeding, and guiding of a record material, such as the normally used typewriter paper, and is designed for use with a rigid, massive platen bar having a generally flat surface for backing up the paper along the writing line. Two mating feed rollers are used. One, preferably the outer roller, being driven and having a fixed axis position and the other having an adjustably supported axis which can be moved out of parallelism with the axis of the driven roller to correct for skew feeding by changing the rolling radius of the rollers, from one end to the other, thus providing a change in paper feeding direction. To make this practical, and to simplify the infeed paper guides, each roller is made the same size and is fitted with a plurality of relatively soft "O" rings or equivalent which are nominally spaced about ½ inch (1.2 cm) apart. With this construction, the inner and outer infeed guides next to the platen working surface need not be divided inasmuch as the "O" rings can project through slots to engage the paper between the guides.A lifting mechanism is applied to the spring-loaded follower roller of the pair for separating the rollers for insertion of the paper up against a retractable sliding alignment guide which has fingers that are projected into the paper path near the writing line. The top edge of the paper is thus precisely aligned to start feeding in synchronism with the stepping of the drive feed roller when the lifting mechanism is released and the alignment guide retracted.

The inner and outer paper infeed guides as well as the paper exit guide, which is above the writing line, are conformally curved to hold the paper against the platen surface. The infeed curve of the guides projects slightly beyond the plane of the platen surface by about a nominal 0.020 inches (0.5 mm) so that the paper exits directed toward and against the platen surface. By this means, a rapid reverse bend is applied to the paper because it is pressed against the platen surface immediately below the writing line. Above the writing line, the front surface of the platen is continued upward by the paper exit guide for a distance of at least ½ inch (1.2 cm). At this point, the exit paper guide gradually curves backward at an increasing rate of curvature which essentially conforms to that taken by a sheet of heavy bond paper as it lays over when projecting about 6 inches (15 cm) or more from the writing line. By doing this no retaining bail is needed. If the printing surface of the platen is tilted back about 5° not even the transparent printing area cover is need to gently guide the paper when it first exits from the writing area.

The exit guide is isolated from the conducted noise in the platen bar by mounting it on at least two groups of rubber isolation bushings, or a foam rubber cushion strip as an alternate. To further extend the noise control, the upper end of the paper exit guie, which is extended around to where the top of the conformally curved surface is below the horizontal, is continued into a flap which is retained by the exit guide by an integral piano type hinge. This flap is made wide enough in the rearward direction to almost contact the initial paper infeed guide so as to close off the cavity behind the exit guide and the rear of the platen bar and thus choke off much of the imprinting noise generally radiated from this cavity. The flap is, of course, pivoted downward for paper insertion.

In this invention both of the mating feed rollers are desirably made with the same working diameter for the "O" rings so as to secure feeding of the record material along a straight line while therebetween. This improves feeding accuracy and eliminates shingling if the record material comprises multiple sheets. This straight line feeding, as well as the use of "O" rings per se, aid in eliminating any treeing tendency.

The use of "O" rings spaced along rigid round bars also makes it possible to keep the feed roller diameter small and hence enable much faster paper feeding, particularly during vertical tabbing, thus speeding up the machine output.

Further, the use of "O" rings aids in correcting for skewed feeding inasmuch as the "O" rings do not have to be as soft as full length resilient cover material would have to be in order to be sufficiently compressible to secure the desired change in rolling radius to correct for the skewed feeding. In addition, the use of full length of long segments of very soft covering material on the feed rollers would enhance the treeing tendency, particularly in feeding thin record material.

DESCRIPTION OF THE DRAWINGS

FIG. 8 is a front elevation of the platen bar of FIG. 1 showing the inner feed roller support ribs as well as the grooves for the paper alignment guide of FIG. 7.

FIG. 9 is a plan view of an inner paper feed roller support arranged for positional adjustment by means of an eccentric bushing.

FIG. 10 is a right end detail of the structure in FIG. 9 with the eccentric axis in one preferred direction in relation to the inner and outer feed rollers.

FIG. 11 is similar to FIG. 10 but with the eccentric axis basically oriented 90° from that in FIG. 10.

FIG. 12 is an enlarged end view through a pair of cooperating feed rings as shown in FIGS. 3 and 10 illustrating the straight line of action when the feed rollers are the same diameter.

FIG. 13 is similar to FIG. 12 but shows the compound curved line of action when one feed roller is much larger in diameter than the other.

FIG. 14 is a left end elevation of a flat platen bar incorporating a specially curved exit paper guide fitted with a noise control flap.

FIG. 15 is a partial cross-section detail of one method of insulating the paper exit guide of FIG. 14 from the platen bar to achieve a reduction in generated imprinting noise.

DETAILED DESCRIPTION

The paper feeding and guiding system of this invention can be applied to printers and typewriters of many types. The system is shown and described herein as applied to a printer which employs individual type chips which are stored in a drum which is rotated for chip selection to a position where the chip is pushed out of the drum into an impressing member which carries the chip to the imprinting position. Such a type font structure is shown in my U.S. Patents:

3,731,778 May 8, 1973, "Printer Having Individual Character Chips;" and 3,892,303 July 1, 1975, "Type Font Changing Mrchanism and Controls."

These patents are incorporated herein by reference and may be referred to for printer details not shown or described herein.

Figure 1:
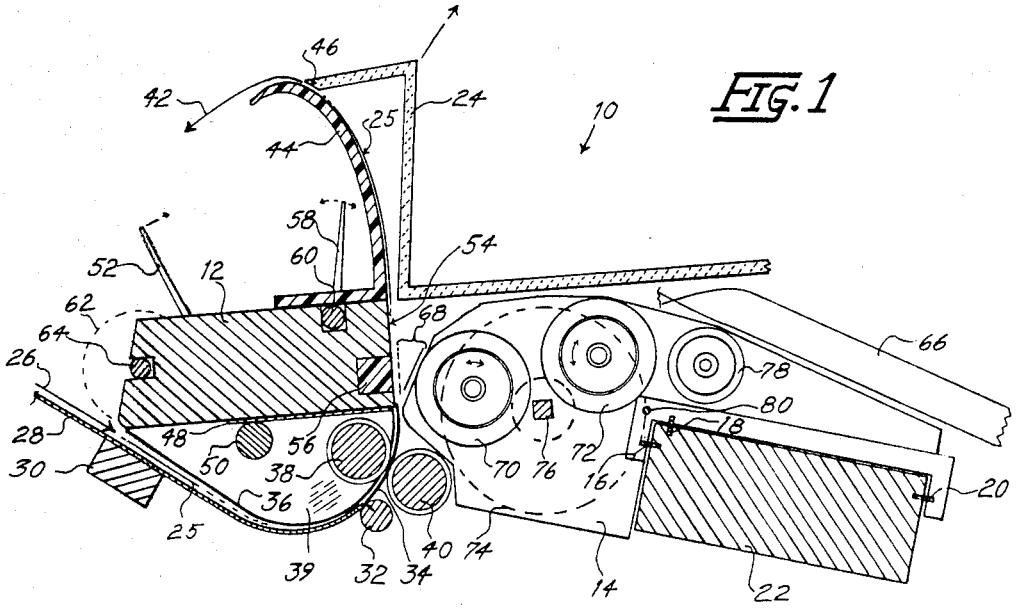
FIG. 1 shows a partial cross-section elevation, taken from the left side, of a printer having a rigid flat platen bar and incorporating the paper feeding and guiding of this invention.

FIG. 1 shows the essential elements of a printer, generally designated by the numeral 10, which is designed to print with individual character type chips as further shown and described in the above referenced patents. To accomplish this objective, the printer 10 is fitted with a massive platen bar 12 having a generally flat face in the writing area. A print carriage 14 is slidably supported on three narrow guide rails: front rail 16, top rail 18, and back rail 20, which are fixed in a massive carriage support bar 22. A transparent printing area cover 24 provides part of the radiated imprinting noise reduction system of the printer. This cover 24 is hinged, by means not shown, to either part of the printer case or to the upper edge of the keyboard support, and may be swung upward and away from the printing area for access thereto.

The input path for record material 25 is indicated by arrow 26 and is directed to the writing line along the face of platen bar 12 by inner and outer paper guides. Outer guide 28 is supported by fixed transverse bars 30 and 32. A thin springy outer front paper guide 34 is also supported by bar 32 and serves as a flexible extension of outer guide 28. An inner paper guide 36 is retained on two lateral ribs 37 and 39, the right rib 39 shown in this figure, which are attached to the bottom of platen bar 12, and completes the paper or record material in-feed channel and directs the paper between the spring-loaded inner feed roller 38 and the driven outer feed roller 40 and thence to the printing area.

The record material exit path is indicated by arrow 42. Record material leaving the writing line or printing area is guided along the front surface of specially curved exit guide 44 and may be loosely confined thereto by the upper edge 46 of cover 24. Alignment of the top edge of an inserted piece of record material is obtained by a paper alignment guide 48 which is temporarily projected into the infed record material path just below the writing line as it exits from between inner guide 36 and front guide 34. Alignment guide 48, which is slidably supported, cooperates with a shaft 50 which is part of the lifting mechanism, not shown, which separates the feed rollers 38 and 40 for record material loading. Shaft 50 is connected to lever 52 which is rotated clockwise by the operator before record material insertion and released after record material alignment against guide 48. The releasing action or counter-clockwise rotation of shaft 50 retracts alignment guide 48 and effects re-engagement of the feed rollers 38 and 40.

Platen bar 12 has a generally flat face 54 in the printing area for backing up and supporting the record material along the writing line. A convexly curved face may also be used but this requires that the type face be conformally curved. Platen bar 12 may have a slightly resilient back-up surface behind the writing line such as insert 56 which may be of a plastic such as nylon. Platen bar 12 is adjusted for the thickness of the record material by lever 58 attached to shaft 60. Platen bar 12 may be tilted for to-to-bottom impression depth control by means of a possible knob 62, shown dotted line, attached to a transverse shaft 64. Both shafts 60 and 64 are fitted with eccentrics on each end thereof which engage respective slots or holes in the printer frame structure which supports the ends of platen bar 12.

A ribbon is generally indicated at 66. In the printing area between the carriage 14 and the platen face 54, the ribbon can assume one of two positions, solid line and dotted line as collectively indicated at 68. The solid line position is assumed when at rest or during transport. During imprinting, the print mechanism pushes the ribbon to the approximate dotted line position parallel to the face of the platen 12 and the record material.

The print carriage 14 has a mechanism for making a line of imprints with individual type-face-bearing chips as shown in the referenced U.S. Pat. No. 3,731,778 and may have a printing mechanism similar to that shown schematically in this reference, or may have a squeeze printing mechanism, details not shown here, but shown in my co-pending U.S. patent application Ser. No. 422,923 filed Sept. 24, 1982, entitled "Squeeze Printing Mechanism". The squeeze printing mechanism is operated by a primary actuator 70 and a secondary actuator 72, both being of the rotary electromagnetic type. Carriage 14 laterally retains a type font drum 74 which is slidably supported on a square drive shaft 76. A type font comprising a plurality, ninety-six for example, of type chips, each having a type face, are accessably stored in drum 74. The font drum 74 is rotated by a stepping motor 77 to selectively position a desired type chip for retrieval and printing therewith as shown in the referenced U.S. Pat. Nos. 3,731,778 and 3,892,303. In printer 10 a selected type chip is pushed out from its storage position in drum 74 by means of solenoid 78 which linearly acts on a narrow blade which enters a slot in the back of drum 74 to act upon the selected type chip.

In FIG. 1, the printer 10 is tilted back about 5° for good lighting of the writing area, and also to cause the record material 25 to naturally lay against exit guide 44.

Figure 2:
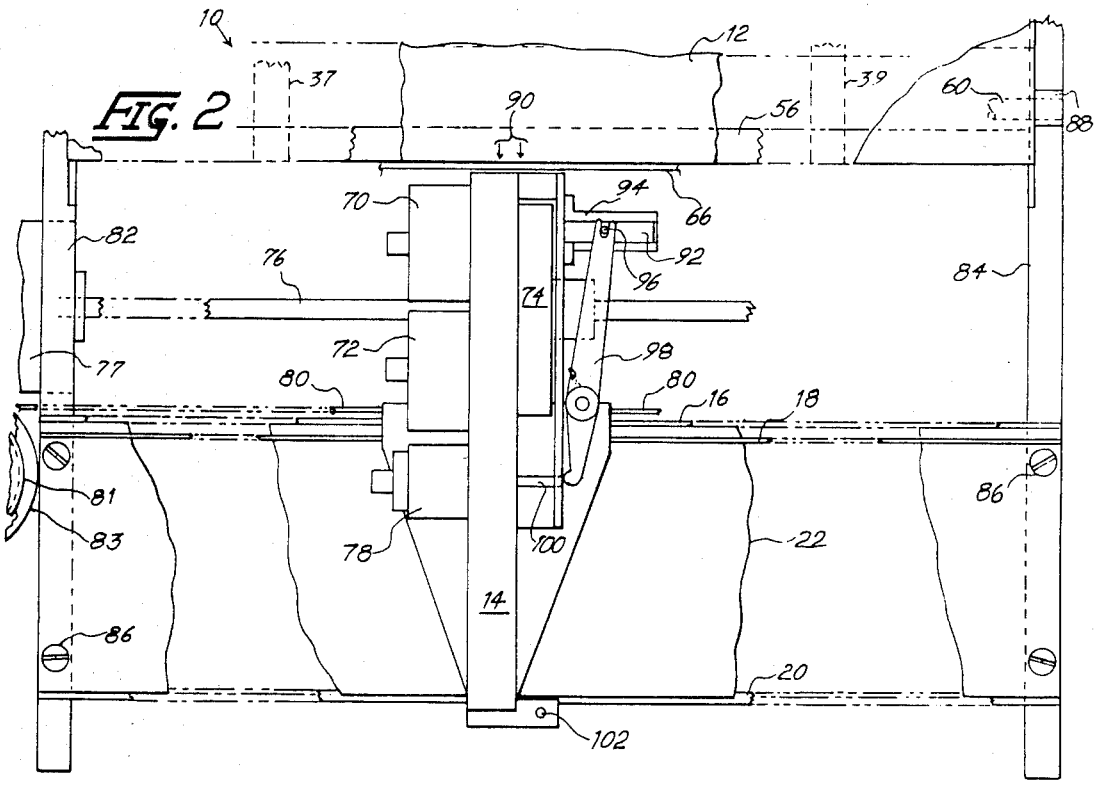
FIG. 2 is a partially cutaway top view of the printer in FIG. 1 with the platen bar rotated forward 15° so that its face is normal to the plane of the carriage support bar for illustrative clarity.

In FIG. 2, the general planform of printer 10 can be seen. The carriage support bar 22 may be attached to the left and right side plates 82 and 84, respectively, by screws 86, or preferably side plates 82 and 84 would be integral with the carriage support bar 22 as a casting. Side plates 82 and 84 are appropriately machined and fitted to retain platen bar 12 and to provide bearing surfaces for the adjustment eccentrics on the ends of shafts 60 and 64. One such eccentric is indicated at 88 and is on the righthand end of shaft 60. Another similar eccentric is on the lefthand end of shaft 60.

The approximate instant print area on platen bar 12 is defined by the twin boundry arrows 90. Type chips are removed from the font drum 74 and injected into the impressing member of the print mechanism by blade 92 which slides in support 94. Blade 92 has a projecting pin 96 which is engaged by lever 98 which, in turn, is moved counter-clockwise to inject a chip by means of solenoid 78 acting through push rod 100 and restored by a spring.

Carriage 14 is positioned along bar 22 and hence along the writing line by a cable drum 81 on a stepping motor 83 acting through cable 80. This type of carriage positioning mechanism is shown in more detail in the referenced U.S. Pat. No. 3,892,303.

The back end of carriage 14 has a hole 102 in the guide extension for engaging an articulated ribbon guide member such as that shown in my U.S. Pat. No. 4,047,607 Sept. 13, 1977, "Articulated Ribbon-Guiding Structure." The on-carriage ribbon guides can be positioned in a manner similar to those shown schematically in that patent. If the ribbon 66 is brought up and over the carriage 14 as shown in FIG. 1, the on-carriage ribbon guides are made of partially twisted metal strips to effect a vertical bend in the ribbon path as is well-known in the art.

Figure 3:
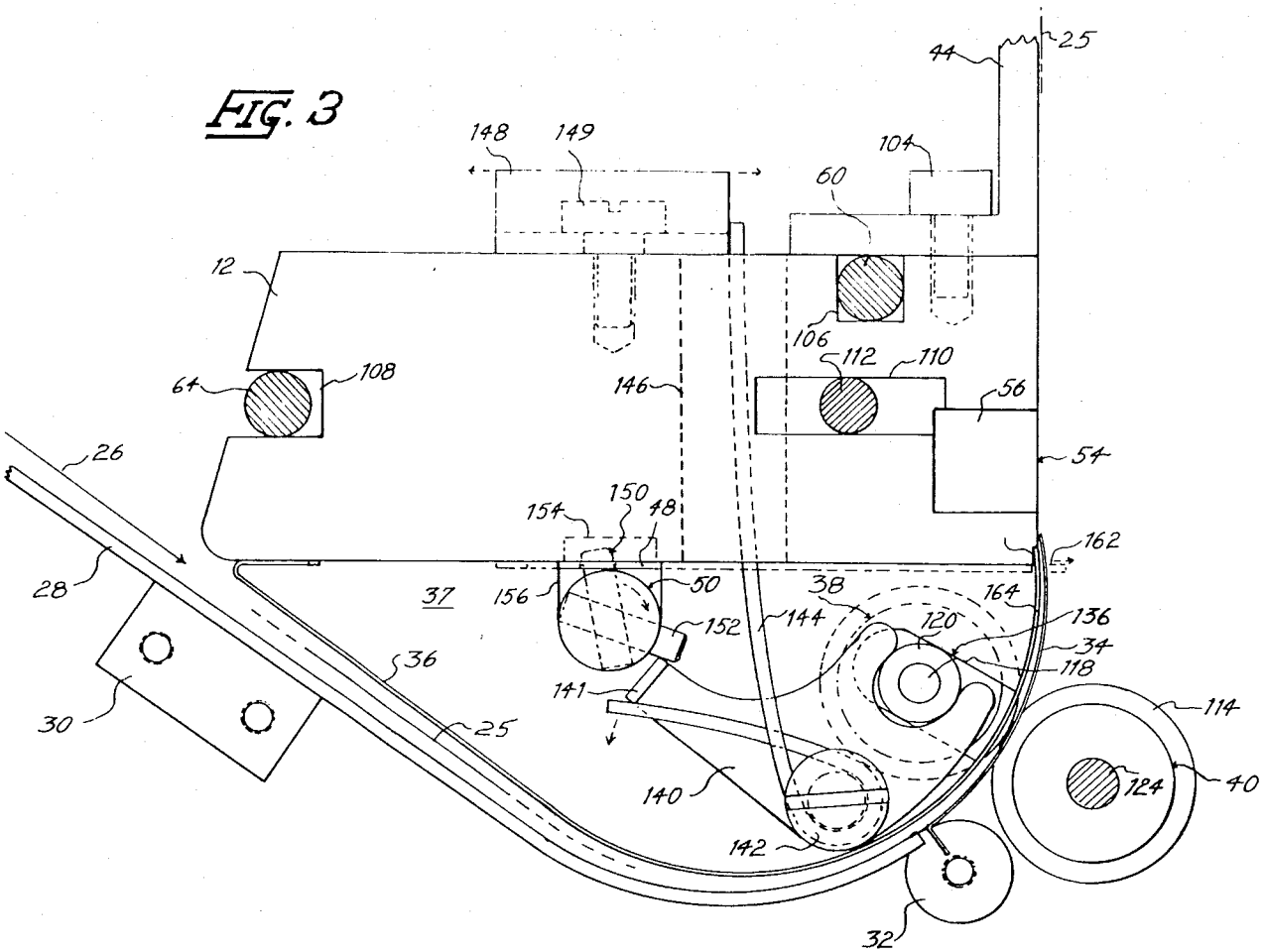
FIG. 3 is a left end elevation showing the platen bar and paper feed rollers of FIG. 1 in greater detail.

Referring now to FIG. 3 showing greater detail of the left end of the platen bar 12 and in-feed guiding and feeding construction, exit guide 44 is retained on platen bar 12 by screws 104. Guide 44 also retains thickness adjustment shaft 60 in groove 106. To accomodate for back and forth movement of bar 12, groove 106 is made sufficiently deep to prevent the front edge of the groove interfering with the tilt adjustment shaft 64.

When platen tilt adjustment is incorporated, the ends of platen bar 12 have shallow grooves 110 precisely machined therein, the right end of bar 12 being a mirror image of that shown. These grooves 110 are engaged by pins 112 which project inward from side plates 82 and 84. Thus platen bar 12 is free for limited rotation about pins 112 by eccentric-fitted shaft 64, and for limited back and forth paper or record material thickness adjustment by eccentric-fitted shaft 60. The pressure from the squeeze imprinting is mostly taken in shear at the ends of shaft 60.

Figure 4:
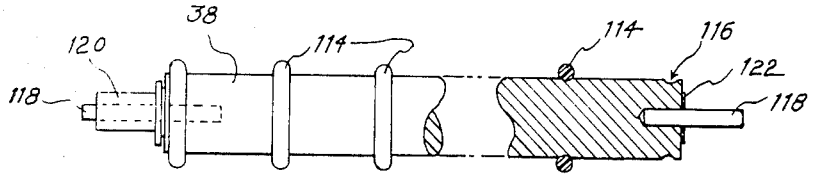
FIG. 4 is a detail view showing the construction of the inner paper feed roller.
Figure 5:
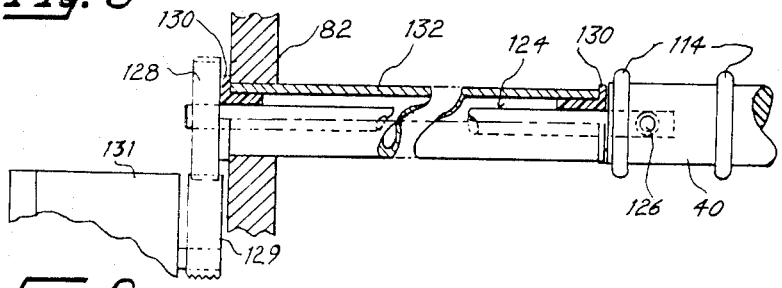
FIG. 5 is a detail view showing the construction of the outer or primary feed roller and its support.

Feed rollers 38 and 40 are shown in detail in FIGS. 4 and 5. Both rollers 38 and 40 are preferably made up of solid round metal bars fitted with a plurality of "O" rings 114 which are retained in shallow circumferential grooves 116. The inner feed roller 38 in FIG. 4 has short stub shafts 118 in each end. A tubular plain bearing 120 and a thrust washer 122 are placed upon each stub shaft 118. The outer feed roller 40, shown in detail in FIG. 5, has a long shaft 124 which is insertable into one end of roller 40 and clamped with a set-screw 126. The other end of shaft 124 is fitted with a spur gear 128 which mates with another gear, 129 which is driven by a stepping motor 131. Shaft 124 is journalled in bearings 130 which are supported by a tube 132 which is pressed into side wall 82 and extends inward. A thrust washer may be used between roller 40 and the adjacent bearing 130. The other end of roller 40, not shown, may have a stub shaft journalled in only one bearing 130, which, in turn, is supported by another tube 132 pressed into the right side wall 84, on a long shaft which extends out through the right side of the printer case and is fitted with a knob for manual rotation of the feed roller when desired. Additional bearings to support this long shaft would be fitted as required.

Referring now to FIG. 8 which shows a front elevation of platen bar 12, the relative locations of ribs 37 and 39 can be seen. These ribs are positioned in lateral grooves cut in the bottom of bar 12 and are retained by screws, not shown, or may be integral with the platen bar 12. Ribs 37 and 39 have notches 134 for supporting and guiding an alignment guide 48. U-shaped slots 136 receive and support bearings 120 and thus inner feed roller 38. Platen bar 12 also has a notch 138 in the right end, as indicated by the dotted line, for clearing loading lever 52. The relative depth of the platen support grooves 110 is also shown dotted line.

Referring back to FIG. 3, it can be seen how ribs 37 and 39 receive the inner feed roller assembly of FIG. 4 in U-shaped slots 136, with the bearings 120 being slidably supported therein. Bearings 120 are made sufficiently long to project outwards from slots 136 to engage forked ends of lifting levers 140 which are pivoted on shoulder screws 142. Stiff springs 144 engage bent up projections 141 on the end of levers 140. The assembly on the right side of the platen is a mirror image of that shown in FIG. 3. The other ends of springs 144 extend upward through holes 146 in platen bar 12 and are engaged by a skew feed adjustment bar 148 pivoted at the top center of bar 12 on shoulder screw 149. Thus bar 148 can be manually moved in one direction or the other to apply more pressure to one end of roller 38 and less pressure to the other end thus causing a concommitant change in compression on the "O" rings on rollers 38 and 40 and, by this means, changing the rolling radius of the pinch area between the rollers 38 and 40 from one end to the other. This change in rolling radius means that the record material 25 or other paper will be fed a greater distance on one side than the other and thus skew feeding can be corrected or adjusted.

The disengagement or separation of feed rollers 38 and 40 in order to permit infed record material to be pushed up against alignment guide 48, to be further described, is accomplished manually via loading lever 52, shown in FIG. 1, shaft 50, and levers 140. Loading lever shaft 50 has two pairs of roll pins inserted therein which straddle ribs 37 and 39. Pins 150 project upward and engage respective slots in alignment guide 48. Pins 152 project forward and downward from shaft 50 to engage the projections 141 on levers 140. Thus when lever 52 is moved and shaft 50 rotated clockwise, the inner feed roller 38 is lifted out of engagement with the driven feed roller 40. The upper ends of pins 150 project into clearance grooves 154 in the bottom of platen bar 12. Loading lever shaft 50 is journalled in U-shaped slots 156 in ribs 37 and 39 when the ribs are retained by screws. If the ribs 37 and 39 are made integral with bar 12, as previously described, slots 156 would have to be holes and pins 150 and 152 would have to be removable for insertion of shaft 50. Other arrangements are, of course, practical.

Figure 6:
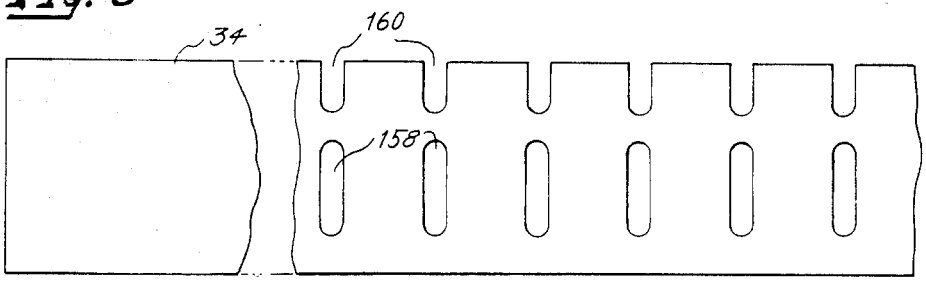
FIG. 6 is an enlarged partial elevation view of the perforations in the inner and outer front paper guides.
Figure 7:
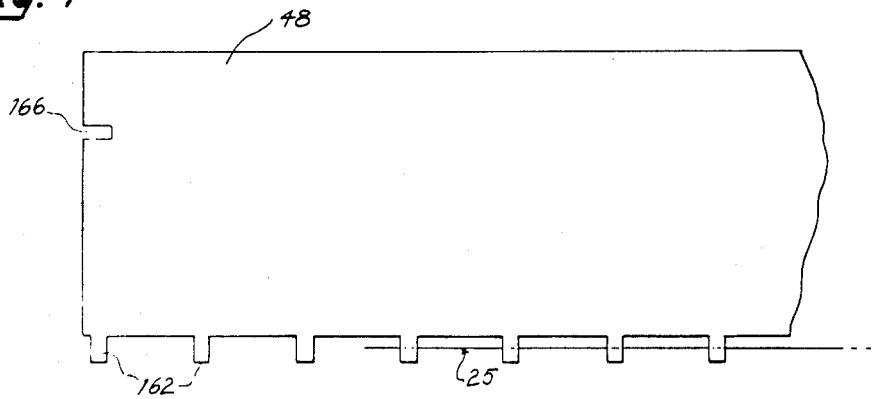
FIG. 7 is an enlarged partial plan view of the top of the paper alignment guide used in the printer of FIG. 1.

FIG. 6 shows the left end of front guide 34 and shows the clearance slots 158 for the "O" rings 114, and clearance notches 160 for the finger-like projections 162, FIG. 7, in alignment guide 48. The front portion 164 of inner guide 36, FIG. 3, is similarly slotted and notched to clear "O" rings 114 and projections 162. FIG. 7 also shows notches 166 in the ends of alignment guide 48 which are engaged by pins 150 in shaft 50. With this construction, projections 162 on alignment guide 48 are extended into the path of the infed record material when the loading lever 52 is moved forward to lift feed roller 38 out of engagement. It therefore can be seen that the top edge of an infed sheet of paper or other record material is always aligned exactly in the same relation to the feed rollers and writing line and thus the top margins of successive sheets of typing will be identical, as will the vertical tab positions.

In the construction shown for printer 10, the preferred location for the paper alignment guide 48 is just below the writing line. The second preferred location for guide 48 is on top of the platen bar 12 with projections 162 projectable out through clearance slots in the exit paper guide 44 or some similar construction. If the guide 48 is on top of bar 12, and bar 12 in not too thick, the first aligned position for infed paper can be just right for typing page numbers and the like. A third practical location for the alignment guide 48 is to have its projections or fingers extend into the paper or record material infeed path just after the pinch area of the feed rollers. Further, if the paper alignment guide location is at the top of the platen bar 12, the guide can be angled downward to keep the top edge of the paper against the platen face 54.

FIG. 9 shows a different preferred construction of the mounting of the inner or non-driven paper feed roller and location of the skew feed control eccentric. Feed roller 170 has stub shafts 172 in each end thereof which are journalled in brackets 174 fixed to a transverse shaft 176. Brackets 174 are precisely aligned with each other on shaft 176 so that the axis on roller 170 is exactly parallel to the shaft. Feed roller 170 is biased into engagement with a driven feed roller by spring 178. Feed roller 170 is shown fitted with rubber rings 180 which have a rectangular cross-section in lieu of the round cross-section of the "O" rings 114 shown in FIGS. 4 and 5. In this alternate construction, the wider surface area of rings 180 would generally require their being made of a softer rubber than the "O" rings.

Shaft 176 is preferably journalled in side walls 82 and 84 rather than in ribs 37 and 39 of platen bar 12. One end of shaft 176 is fitted with an eccentric bearing bushing 182 which rotates in side wall 84 by means of a lever 184 for correcting skewed feeding of the record material.

FIGS. 10 and 11 show inner feed roller 170 in contact with a driven feed roller 186 and two different ways of initially setting eccentric bushing 182. In FIG. 10 the eccentric axis 188 of bushing 182 is oriented at right angles to the pressure and alignment axis 190 of rollers 170 and 186. If lever 184 is rotated in one direction or the other, the long axis of shaft 176 is moved in the direction of arrows 192 and out of parallelism with driven roller 186 as is the long axis of roller 170. Thus, under the pressure of biasing spring 178, the soft rings 180 on rollers 170 and 186 are compressed more at one end of the rollers than the other which changes the rolling radius of the rings 180. By this means, as previously described, skew feeding of the record material can be corrected.

In FIG. 11 eccentric axis of bushing 182 is initially oriented parallel to the axis 190 of rollers 170 and 186. In this case, if lever 184 is rotated in one direction or the other, one plane of the long axis of roller 170 is shifted one way or the other in the direction of arrows 194 to alter feeding direction of the record material.

FIG. 12 shows how the line of action between two compressed "O" rings 196 and 198 is essentially straight when the "O" rings are the same diameter. Arrow 200 indicates how the paper exits from between the feed roller "O" rings 196 and 198 in the same general plane as the record material infeed direction indicated by arrow 202.

FIG. 13 shows how the line of action between one large diameter "O" ring and one small diameter "O" ring does not form a straight line, due to the smaller ring tending to indent the larger ring. The line of action or area of compression may be more or less straight in the middle portion but tends to curve toward the axis of the smaller ring 206. Thus if infed record material is guided in the direction of arrow 208, the exit direction of the record material will tend to be that of arrow 210 as schematically shown. While this might not be of much consequence when feeding a single piece of record material, it is not good when feeding manifolded material because, when the paper guides before and after the feed rollers are curved, the second, third, and so forth copies, are not fed exactly the same amount and any back and forth vertical tabbing will tend to be out of register.

FIG. 14 shows a preferred paper exit guide 212 mounted on a rigid platen bar 214 which has a slightly resilient insert 216 along the writing line on platen face 218. Exit guide 212 is desirably made about 1.5 inches (38 mm) high with a straight lower portion, between arrows 220 and 222, which is parallel or tangent to the platen face 218. The guiding surface of guide 212 then gradually curves away toward the rear of the printer at an increasing rate to a point where the exiting record material, as indicated by arrow 224, has turned through an angle of not less than 60° and desirably slightly more than 90°. This curve is approximately that which is taken by a sheet of heavy bond typewriter paper as it lays back from the vertical.

FIG. 14 also shows the paper exit guide 212 fitted with a noise control flap 226 which forms an extension of guide 212 and is pivoted thereto by a piano type hinge structure. Flap 226 normally extends backward, (from the front of the printer), and slightly downward until it almost touches the paper infeed guide 228. The gap between flap 226 and guide 228 is desirably no more than twice the thickness of the thickest manifolded record material that would be used in the printer. Infed record material direction is indicated by arrow 230. Flap 226 can be downward to the approximate dotted line position shown for ease of insertion of the record material, particularly small material such as cards and the like. Thus it can be seen that radiated imprinting noise from the rear platen area can be mostly blocked. Noise from the front of the platen and exit guide is mostly suppressed by the window 24 shown in FIG. 1.

To further control and suppress conducted imprinting noise, FIG. 15 shows the paper exit guide 212 made reasonbly massive and vibration-isolated from platen bar 214 by means of soft rubber bushings or buttons 232 which are compressed by means of retaining screws 234. At least two pairs of resilient buttons 234 would be used to keep exit guide 212 from touching the platen bar 214. Naturally, the softness of the buttons 234 would be such that the guide 212 is as flexibly supported as practical.

To complete the description of the preferred paper guiding system it is now necessary to refer back to FIG. 3. Observation and experimentation with printers having flat, or nearly flat platen faces, has shown that special efforts must be made to hold the record material tightly against the platen face in the imprinting area along the writing line to eliminate paper slap and secure precise imprint impressions. This is particularly true when the feed rollers must be located toward the back of the printer and out of direct line with the platen face in order to clear the print carriage structure. It has been found that if the front guide 34 and the front portion 164 of inner guide 36 are curved so that they project slightly forward from a line tangent to platen face 54 and curve back toward face 54, the record material exiting from between these infeed guides is projected against the platen face at a small positive angle, 2° to 6° for example, and forced into firm contact along the writing line. If the record material is then guided tangentially upward well-beyond the writing line area, i.e., well-beyond the top edge of insert 56, and then gradually guided backward at an increasing rate as shown by exit guide 44 in FIG. 1, or exit guide 212 in FIG. 14, the record material will generally remain against the exit guiding surface if the printer is tilted back so that the platen face is off vertical by an angle of 5° to more. In this manner, a customary transverse hold-down bail is eliminated and a clear view of the imprinting is maintained. Even if the 5° tilt is not used, the upper edge 46 of transparent cover 24 will insure that the exiting record material will follow the proper curve.

While the foregoing description has been directed at detailed construction for the preferred embodiments, many variations are practical without departing from the scope of the paper feeding and guiding system. For example, throughout the drawings and description, the platen face is shown and described as being flat. For some types of typewriters it may be desirable to have the platen face curved to a radius such as 3 Inches (75 mm) with the type faces in the type font being similarly curved.

The exit paper guide 44 in FIGS. 1 and 3, or guide 212 in FIGS. 14 and 15, can be made of perforated metal filled and backed with a sound absorbing material. The same construction can be used for the noise control flap 226. Alternatively, the exit guide and noise control flap can be made of a relatively "dead" acoustic material.

As shown and described, the preferred construction of the feed rollers 38 and 40 need not have "O" rings with a round cross-section. The rings can have a square or rectangular cross-section as long as the face width is kept small. Further, after the "O" rings are installed on each rod, it may be desirable to lightly machine, preferably by grinding, each feed roller assembly to get an extremely uniform diameter along each assembled roller and eliminate any molding non-uniformities such as flashings on the periphery of each "O" ring.

With regard to the noise control flap 226 shown in FIG. 14, it is presumed that the printer has a case and that portions of the case extend upward at each end of the platen and exit guide structure and thus close off the ends of the cavity behind and in front of the platen and exit guide. It is further assumed that the infeed guide 228 extends upward at least to the back top of the case 236 as shown.

I claim:

1. In a device which employs record material and having means for guiding, supporting, and feeding said material, the improvement comprising:

two cooperating feed rollers of equal outer diameter supported for rotation about respective axes which are normally parallel to each other, at least three equally compressible rings surrounding each of said rollers and correspondingly spaced therealong, each ring having a face width generally less than $\frac{1}{8}$ inch (3 mm), and means for urging said rollers together to compress each of more than two rings along one roller against a corresponding ring disposed along the other roller, each pair of corresponding compressed rings forming a substantially flat appreciable interface therebetween, the flat interface formed by the compressible rings defining a straight line of action sufficient to provide that said record material engaged between the pairs of corresponding compressed rings are fed therethrough along a substantially flat plane.

2. In device as defined in claim 1 in which each of said feed rollers comprises a round bar having respective equal circumferential grooves thereon for locating and supporting said rings.

3. In a device as defined in claim 1 in which said rings comprise O-rings, and said plurality of rings comprises ten or more rings equally and correspondingly spaced along each of said rollers.

4. In a device as defined in claim 1, adjusting means for moving the respective axes of said rollers closer together at one end so that the rings are compressed more at that end than the other to effect a small change in the direction of feeding said material while maintaining said straight line.

5. In a printer for producing printing along a writing line on record material, and having a frame, a platen adjustable relative to the frame for supporting the record material at the writing line, and means for guiding and feeding the record material past the platen, the improvement comprising:

first and second feed rollers of equal outer diameter supported for rotation about respective axes which are normally parallel to each other, a plurality of more than two narrow and equally compressible rings, each ring having a face width generally less than $\frac{1}{8}$ inch (3 mm) surrounding each of said rollers and correspondingly spaced therealong, and means for urging said rollers together to compress rings on said first feed roller against corresponding rings on said second feed rollers and thus engage said record material for feeding thereof along a straight path while therebetween, said rings compressing against each other defining a flat appreciable interface therebetween, the flat interface defining a straight line of action sufficient to provide that said record material engaged between the pairs of corresponding compressed rings are fed therethrough along a substantially flat plane.

6. In a printer as defined in claim 5 in which each of said feed rollers compress a round bar having respective and equal circumferential grooves thereon for supporting said rings, said printer having record material of more than one layer.

7. In a printer as defined in claim 5 in which said rings comprise O-rings, and said plurality of rings comprises ten or more rings equally and correspondingly spaced along each of said rollers.

8. In a printer as defined in claim 5, driving means coupled to said first roller to effect said feeding, and adjusting means adjacent one end of said second roller for tilting the axis thereof to bring said one end closer to the corresponding end of said first roller so that said rings at one end are compressed more than rings on the other end to feed less material and hence effect a small change in the direction of feeding said material while maintaining said straight path.

9. In a printer as defined in claim 5 in which said first roller is supported by said frame for said rotation about its axis, said second roller is adjustably supported by said platen, and said means for urging said rollers together comprising spring-loaded means acting upon said second roller and also supported by said platen.

10. In a printer having a frame, a non-rotating platen structure adjustably supported by the frame, said platen structure having a generally flat front platen bar face for supporting record material thereagainst to receive a line of printing, said front face having top and bottom edges respectively above and below the line of printing, the improvement comprising:

first and second cooperating feed rollers supported below said platen structure for engaging and feeding said record material therebetween, infeed guiding means positioned generally below said platen structure and having an entrance and an exit for said record material, said infeed guiding means comprising inner and outer guides for guiding the record material from said entrance and therebetween along an increasingly confined path to said feed rollers, and thence along a further increasingly confined path from the feed rollers to said exit, said exit being positioned just above said bottom edge, said outer guide having a thin continuous spring portion extending from a point adjacent said rollers toward said front face to press exiting record material against said front face below said writing line, and said inner and outer guides are positioned to project said record material from said exit upward and against said front face at a small positive angle thereto, said angle being generally not less than two degrees or more than six degrees to effect a stressed condition in said record material so that it will lay tightly against said front face when said record material impinges against said front face at said angle.

11. In a printer as defined in claim 10 in which said first feed roller and said outer guide are supported by said frame, said second feed roller is adjustably supported by said platen structure, and said inner guide is supported by said platen structure so as to move therewith when said structure is adjusted and thus alter said further increasingly confined path for said record material.

12. In a printer as defined in claim 10, exit guiding means supported on said platen structure and positioned to effectively extend said platen front face from said top edge generally upward and back away from the front face for a height of generally 1.5 inches (38.1 mm) or more above the writing line, and said exit guiding means has a front surface profile which first extends the plane of said front face for at least 0.5 inch (12.7 mm) and then curves back and away from said plane at an increasing incremental rate through a substantial angle of thirty degrees or more before said guiding surface is terminated to thus prevent the weight of exiting record material from forming a bend which would force the material away from said front face at said writing line.

13. In a printer as defined in claim 12 in which said front face of said platen structure supports said record material generally within 15° of a vertical position, and said substantial angle is at least 75° so that the record material is guided along a path by said guiding surface and exits therefrom in at least a generally horizontal plane.

14. In a printer as defined in claim 10, said platen structure having a top portion, exit guiding means supported on the top portion of said platen structure, said exit guiding means including a guiding surface which extends upward and back away from the top edges of the front face, wherein the record material lays against said front face at said writing line as record material above said writing line lays against said guiding surface.

15. In a printer as defined in claim 14, wherein said guiding surface is curved to conform generally to the shape said record material above said platen structural naturally assumes.

16. In a printer having a frame, a non-rotating platen structure adjustably supported by the frame, said platen structure having a generally flat front face for supporting record material thereagainst to receive a line of printing, the improvement comprising:

first and second cooperating feed rollers supported below said platen structure for engaging and feeding said record material therebetween, infeed guiding means positioned generally below said platen structure and having an entrance and an exit for record material, said infeed guiding means comprising inner and outer guides for guiding the record material from said entrance and therebetween along an increasingly confined path to said feed rollers, and thence along a further increasingly confined path from the feed rollers to said exit, said exit being below and proximate said writing line, exit guiding means positioned above said platen structure for guiding record material along a continuing path upward and back away from said front face, a plurality of record aligning fingers, positioned upstream of said feed rollers, supported parallel to one edge of said writing line, and means for projecting said aligning fingers into said path of said record material proximate said writing line to intercept and align the top edge of the record material as the material is inserted into said printer.

17. In a printer as defined in claim 16, means for disengaging said first and second feed rollers when record material is inserted into said printer and aligned, said aligning fingers are positioned adjacent to the bottom of said writing line and to said exit of said infeed guiding means, and said infeed guiding means are appropriately slotted so that said aligning fingers can be projected into the path of the record material and so that the aligning of the top edge of the record material is visible.

18. In a printer as defined in claim 16 in which said aligning fingers comprise sliding means.

19. In a printer as defined in claim 18 in which said means for projecting said aligning fingers and said means for disengaging said feed rollers are interconnected.

20. In a printer as defined in claim 16, wherein said aligning fingers are positioned to project into said path of said record material at the bottom of the front face.

* * * * *